US005605242A

United States Patent [19]

Hwang

[11] Patent Number: 5,605,242

[45] Date of Patent: Feb. 25, 1997

[54] STORAGE CONTAINER FOR GRAPHIC SHEET MATERIAL

[76] Inventor: Chin C. Hwang, P.O. Box 1032, Tainan, Taiwan

[21] Appl. No.: 563,274

[22] Filed: Nov. 28, 1995

Related U.S. Application Data

[63] Continuation-in-part of Ser. No. 351,524, Dec. 7, 1994, abandoned.

[51] Int. Cl.[6] ..... B65D 85/00

[52] U.S. Cl. ..... 220/8; 220/4.03

[58] Field of Search ..... 220/4.03, 8, 600, 220/601, 625

[56] References Cited

U.S. PATENT DOCUMENTS

| | | | |
|---|---|---|---|
| 879,370 | 2/1908 | Dennison | 220/8 |
| 1,450,674 | 4/1923 | Marston | 220/8 |
| 1,451,622 | 4/1923 | Marston | 220/8 |
| 3,819,040 | 6/1974 | Coons | 220/8 |

*Primary Examiner*—Joseph M. Moy

[57] ABSTRACT

A storage container includes a cap engaged on the upper portion of a cylindrical body and includes a casing engaged to the lower portion of the cylindrical body. The lower portion includes a number of projections arranged in a column. The upper portion of the casing includes a number of horizontal ribs so as to define a number of channels between the ribs for engaging with one of the projections so as to retain the casing to the cylindrical body. A cylindrical seat is disposed beneath the casing. A strap fastens the cap and the cylindrical seat.

1 Claim, 6 Drawing Sheets

STORAGE CONTAINER FOR GRAPHIC SHEET MATERIAL

The present invention is a continuation-in-part of application Ser. No. 08/351,524, filed Dec. 7, 1994 now abandoned.

BACKGROUND OF THE INVENTION

1. Field of the Invention

The present invention relates to a storage container, and more particularly to a storage container for accommodating graphic sheet materials.

2. Description of the Prior Art

Typical cylindrical storage containers are provided for accommodating graphic sheet material which is coiled with a cylindrical shape. The containers comprise a cylindrical body having a predetermined depth which may not be adjusted for accommodating graphic sheet material having different length. When a graphic sheet material has a shorter length and is disposed in a cylindrical body having a larger depth, the graphic sheet material may not be stably retained in the storage container and may move freely within the storage container.

The present invention has arisen to mitigate and/or obviate the afore-described disadvantages of the conventional storage containers.

SUMMARY OF THE INVENTION

The primary objective of the present invention is to provide a storage container which may be adjusted into different depth for accommodating graphic sheet materials having different length.

Another objective of the present invention is to provide a storage container which can be carried easily.

Accordingly, a storage container comprising a cylindrical body including an upper portion and a lower portion, the lower portion including a plurality of projections formed thereon, a cap for engaging on the upper portion of the cylindrical body, and a casing including an open top for engaging with the lower portion of the cylindrical body and including an enclosed bottom, the casing including an upper portion having at least one channel formed therein for engaging with either of the projections so as to retain the casing to the cylindrical body.

The upper portion of the casing includes at least two ribs laterally formed therein and spaced with each other so as to define the channel therebetween, the channel includes one side having a stop formed thereon for engaging with the projection so as to prevent the projection from disengaging the channel.

The cylindrical body includes an outer periphery surface. The projections are projected radially outward from the outer periphery surface of the cylindrical body.

Further objectives and advantages of the present invention will become apparent from a careful reading of a detailed description which is provided hereinbelow, with appropriate reference to the accompanying drawings.

DETAILED DESCRIPTION OF THE PREFERRED EMBODIMENT

Figure 1:
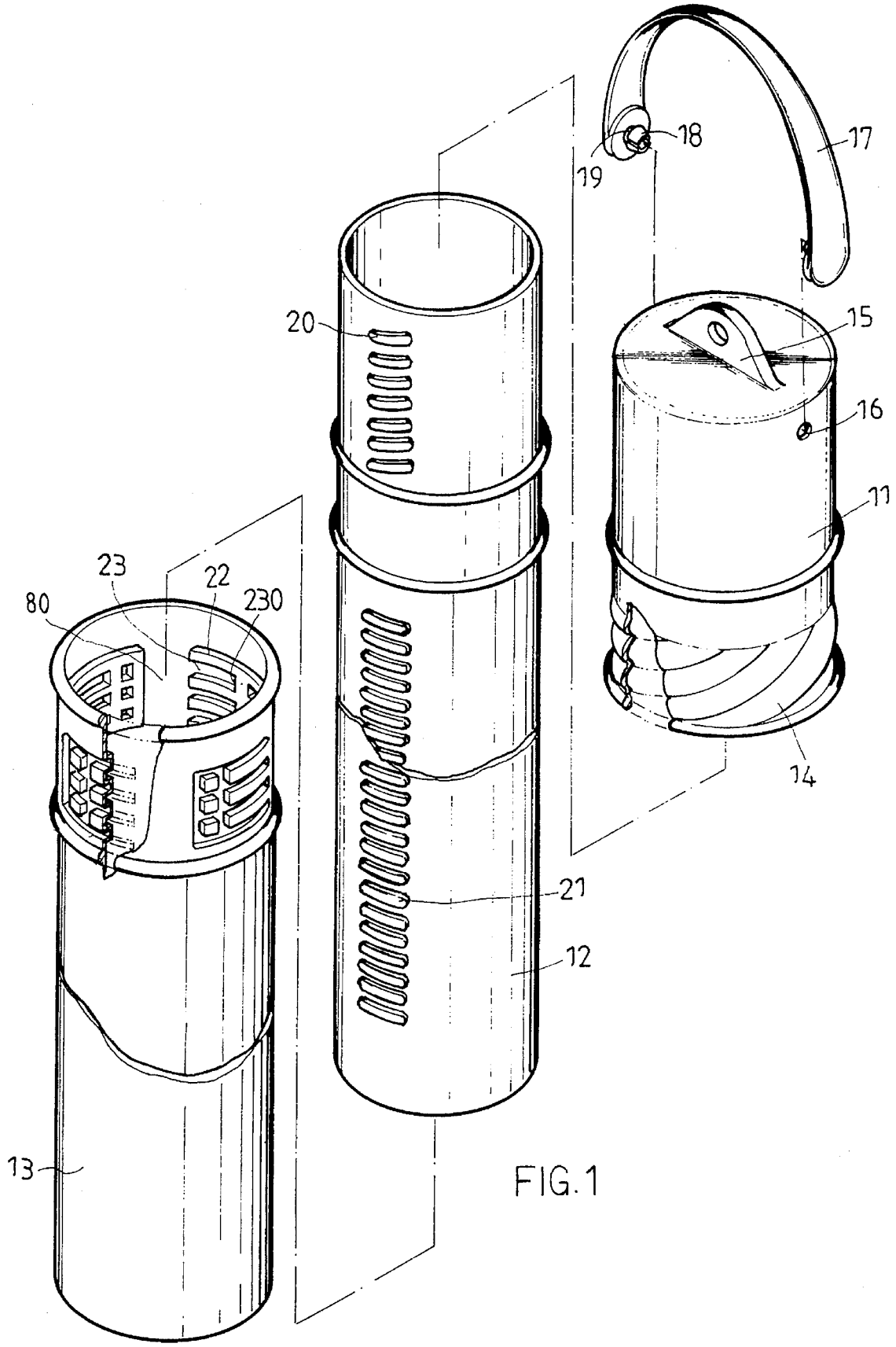
FIG. 1 is a perspective exploded view of a storage container of a preferred embodiment in accordance with the present invention.
Figure 2:
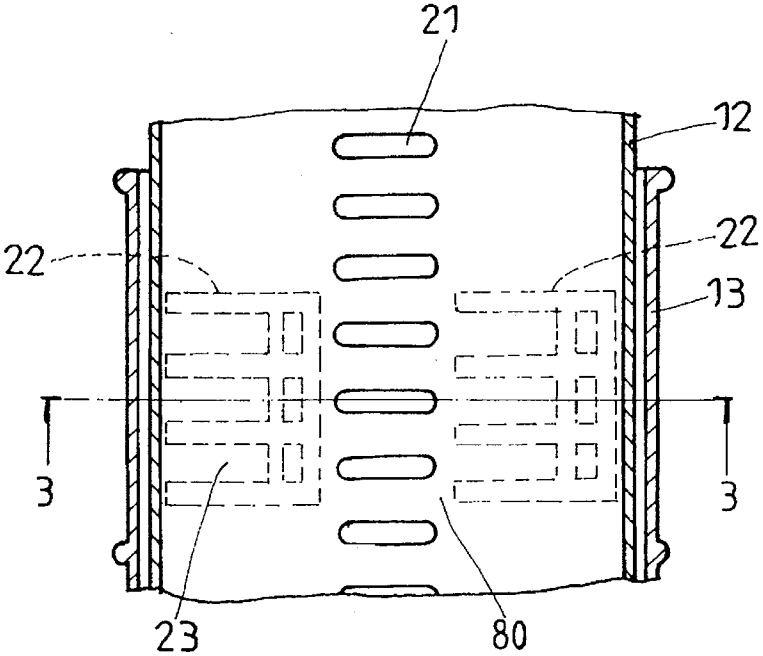
FIG. 2 is a partial cross sectional view taken along lines 2—2 of FIG. 3.
Figure 3:
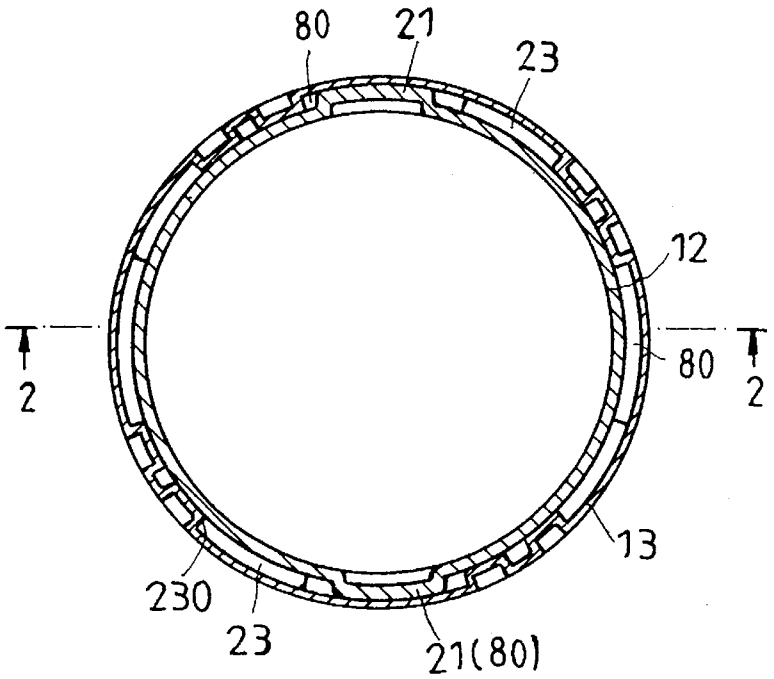
FIG. 3 is a cross sectional view taken along lines 3—3 of FIG. 2.

Referring to the drawings, and initially to FIGS. 1 to 3, a storage container in accordance with the present invention is provided for accommodating graphic sheet materials which are coiled into cylindrical shape. The storage container comprises a cap 11, a cylindrical body 12 and a casing 13. The cylindrical body 12 includes an upper portion having a number of inclined protrusions 20 which are arranged in two columns, and includes a lower portion having a number of horizontal projections 21 which are also arranged in two columns, as shown in FIG. 3. The cylindrical body 12 includes two open ends.

Figure 6:
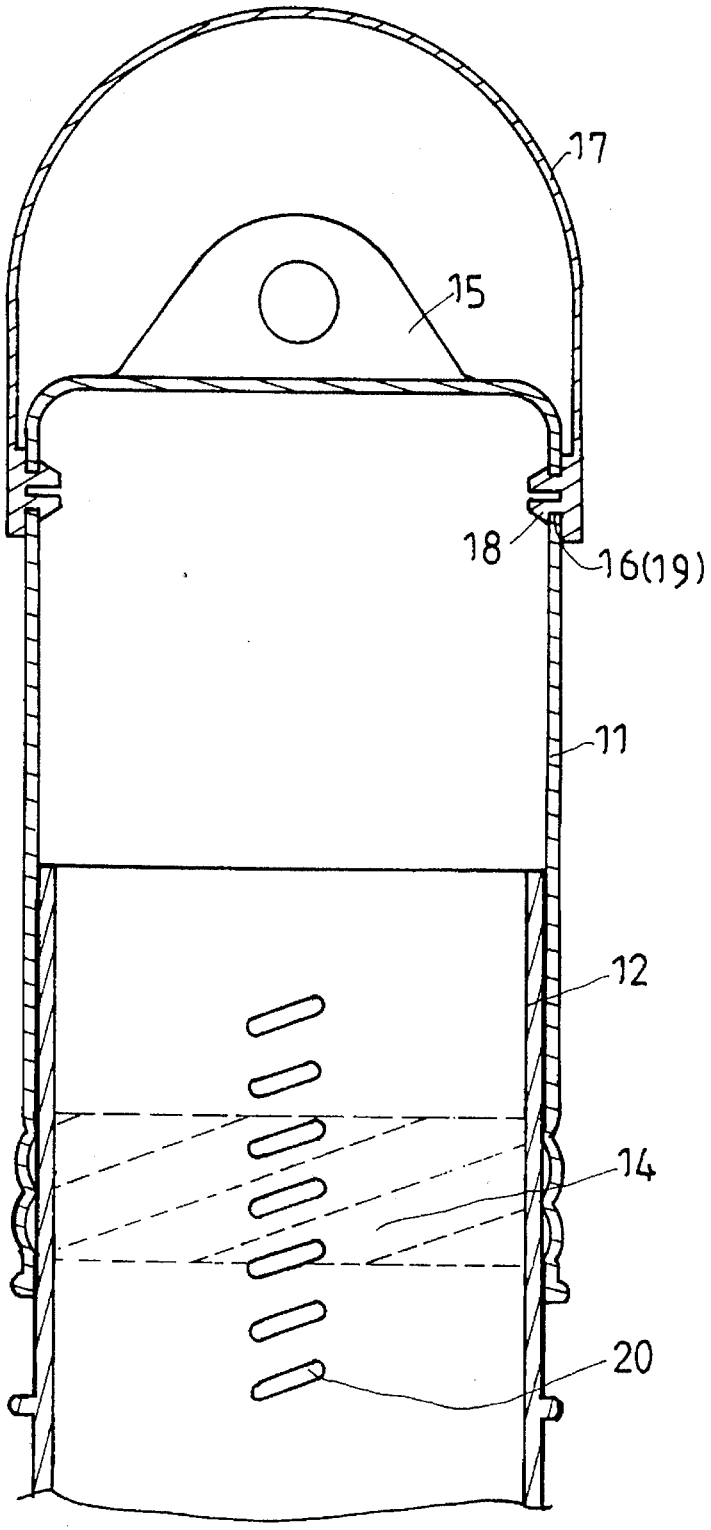
FIG. 6 is a partial cross sectioal view illustrating the configuration of the cap.

The cap 11 includes a lower portion having a thread portion 14 formed therein for engaging with the inclined protrusions 20, as shown in FIG. 6, and includes an upper portion having two holes 16 oppositely formed therein. A handle 17 includes two ends each having a retainer means 18 formed thereon for engaging with the holes 16 respectively and each having an annular groove 19 formed therein for engaging with the wall member of the cap 11. The retainer means 18 includes a ring-shaped body having a pair of slits oppositely formed therein so as to separate the ring body into two hook members for engaging with the cap, as shown in FIG. 6. The cap 11 further includes a lug 15 formed on top thereof for hanging the storage container.

The casing 13 includes a cylindrical shape having an open upper end for engaging with the lower portion of the cylindrical body 12 and a closed bottom end. The casing 13 includes an upper portion having four columns of ribs 22 laterally formed thereon. The four columns each includes four ribs 22 arranged in parallel to each other and spaced from each other so as to define three channels 23 for engaging with the horizontal projections 21 of the cylindrical body 12. A stop 230 is formed in one side of the channels 23 for engaging with the projections 21 and for retaining the projections 21 in place. As shown in FIGS. 2 and 3, a gap 80 is formed between every two adjacent columns of the ribs 22 and has a size slightly larger than that of the projections 21 so that the projections 21 may move along the gaps 80 and may engage with the channels 23. As shown in FIGS. 2 and 3, the projections 21 are not engaged with the channels 23 yet and are engaged in the gaps 80.

Figure 4:
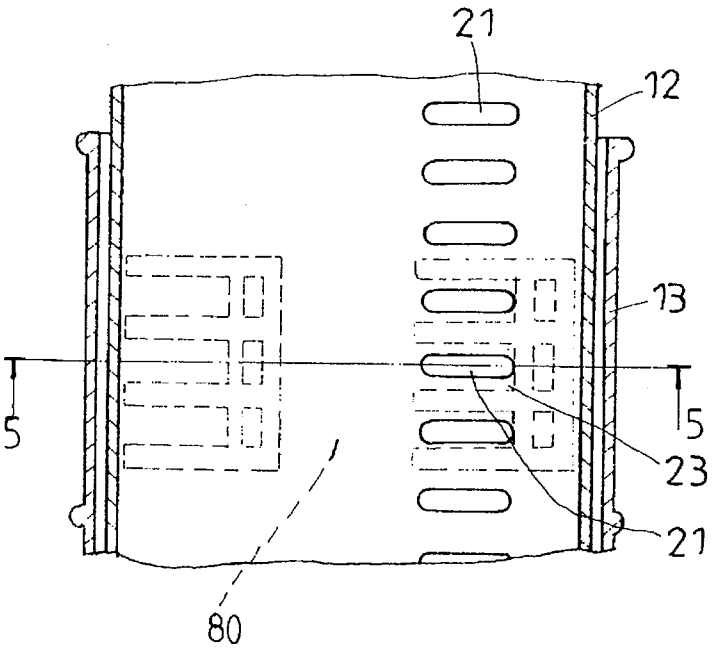
FIG. 4 is a partial cross sectional view taken along lines 4—4 of FIG. 5, for illustrating the operation of the storage container.
Figure 5:
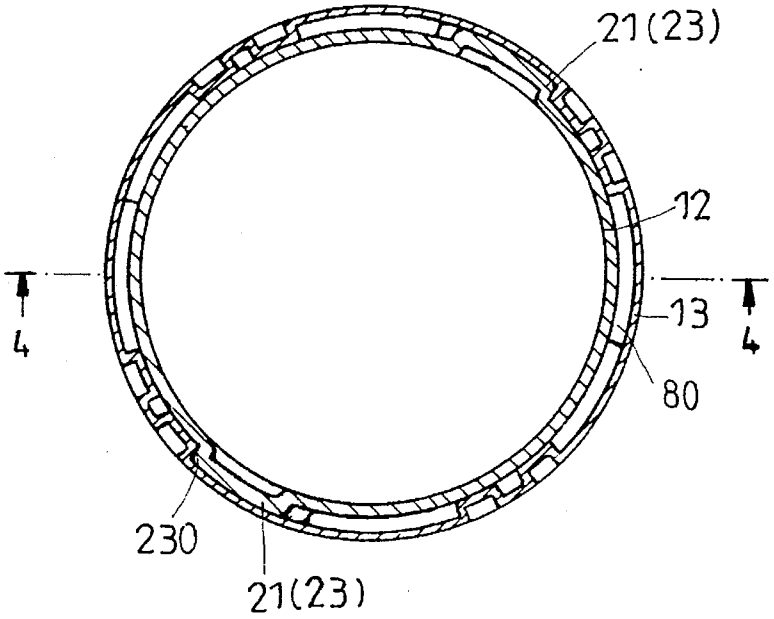
FIG. 5 is a cross sectional view taken along lines 5—5 of FIG. 4.

Referring next to FIGS. 4 and 5, when the casing 13 is moved upward or downward relative to the cylindrical body 12 to a predetermined position and rotated relative to the cylindrical body 12, the projections 21 may be engaged with the channels 23 so that the casing 13 may be easily adjusted relative to the cylindrical body 12 in order to adjust the length to a predetermined length.

It is to be noted that the protrusions 20 and the projections 21 are projected outward from the peripheral portion of the cylindrical body 12 such that the cylindrical body includes an inner peripheral surface having no projections projected radially inward therefrom, best shown in FIGS. 3 and 5.

In operation, the cap 11 may first be engaged on the upper portion of the cylindrical body 12. Then the graphic sheet materials which are coiled into cylindrical shape may be engaged within the cylindrical body 12. The casing 13 is then engaged on the lower portion of the cylindrical body 12 and is moved relative to the cylindrical body 12 so as to solidly retain the graphic sheet material within the storage container. The casing 13 is then rotated relative to the cylindrical body 12 so as to engage the projections 21 within the channels 23 so that the graphic sheet materials may be stably retained within the storage container.

Figure 7:
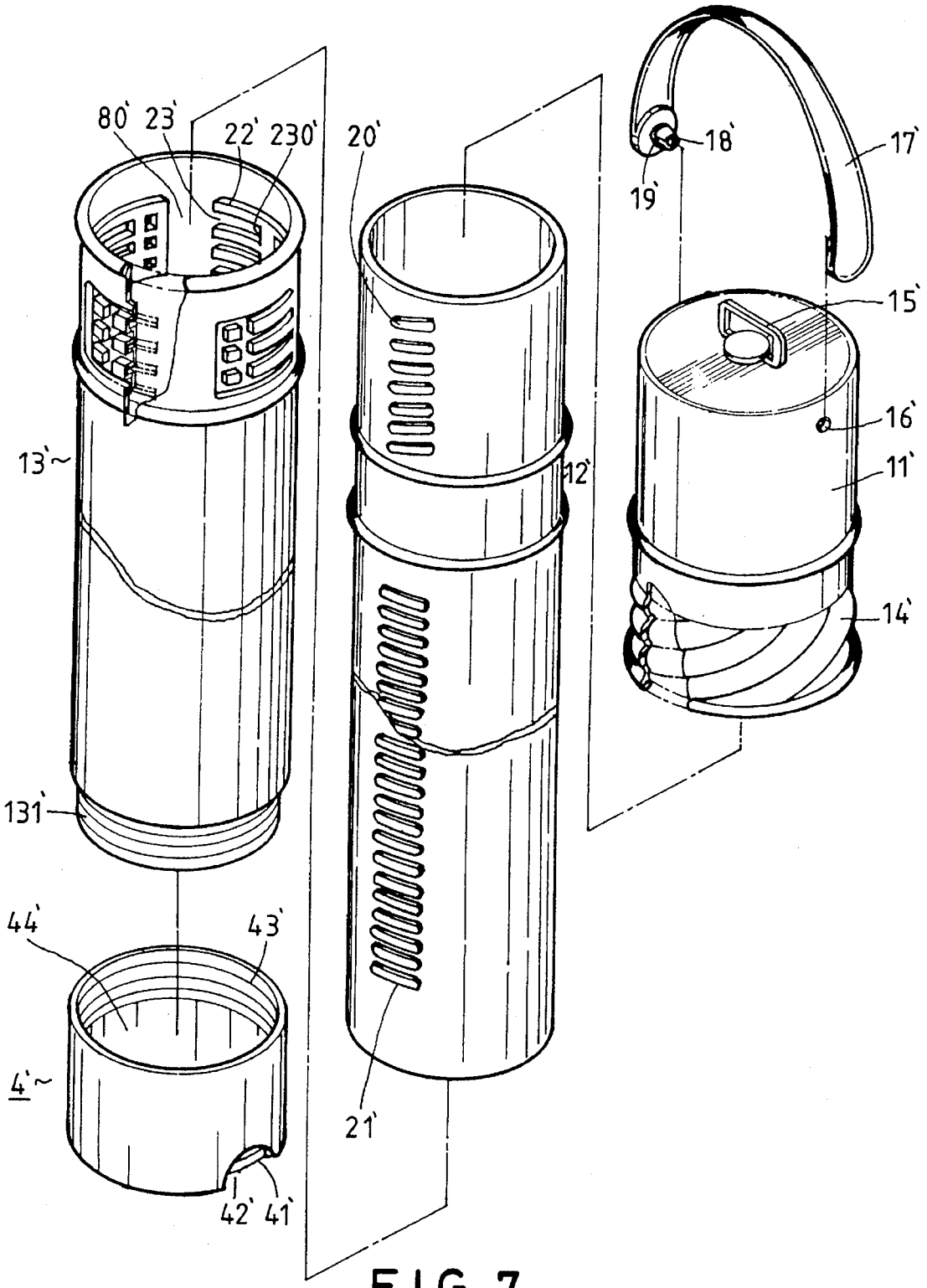
FIG. 7 is a perspective exploded view of a storage container of another preferred embodiment in accordance with the present invention.
Figure 8:
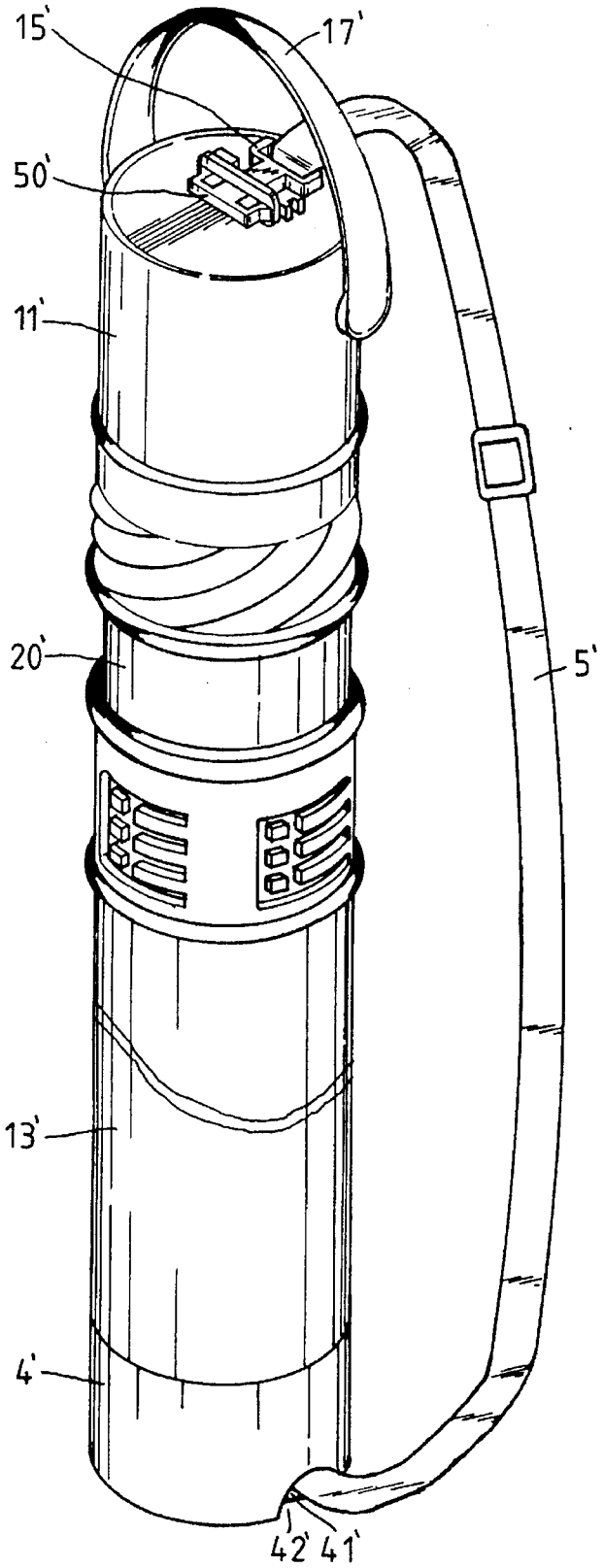
FIG. 8 is a perspective assembly view of a storage container and a strap of another preferred embodiment in accordance with the present invention.

Referring to FIGS. 7 to 9, another storage container is provided for accommodating graphic sheet materials. The storage container comprises a cap 11', a cylindrical body 12' and a casing 13'. The cylindrical body 12' includes an upper portion having a number of inclined protrusions 20' which are arranged in two columns, and includes a lower portion having a number of horizontal projections 21' which are also arranged in two columns. The cylindrical body 12' includes two open ends.

The cap 11' includes a lower portion having a thread portion 14' formed therein for engaging with the inclined protrusions 20' and an upper portion having two holes 16' oppositely formed therein. A handle 17' includes two ends each having a retainer means 18' formed thereon for engaging with the holes 16' respectively and each having an annular groove 19' formed therein for engaging with the wall member of the cap 11'. The retainer means 18' includes a ring-shaped body having a pair of slits oppositely formed therein so as to separate the ring body into two hook members for engaging with the cap 11'. The cap 11' includes a fastener seat 50' and a fastener 15' on top thereof for hanging the storage container.

The casing 13' includes a cylindrical shape having an open upper end for engaging with the lower portion of the cylindrical body 12' and a closed bottom end. The casing 13' includes an upper portion having four columns of ribs 22' laterally formed thereon. The four columns each includes four ribs 22' arranged in parallel to each other and spaced from each other so as to define three channels 23' for engaging with the horizontal projections 21' of the cylindrical body 12'. A stop 230' is formed in one side of the channels 23' for engaging with the projections 21' and for retaining the projections 21' in place. A gap 80' is formed between every two adjacent columns of the ribs 22' and has a size slightly larger than that of the projections 21'. The casing 13' has a threaded end 131'. A cylindrical seat 4' has a hollow interior 44', an inner threaded rim 43' to receive the threaded end 131', a notch 42' and a lower fastener 41'. The cap 11' has a fastener seat 50' to connect an upper fastener 15'. A strap 5' fastens two fasteners 41' and 15'.

Accordingly, graphic sheet materials may be stably retained within the storage container in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A storage container comprising:

a cylindrical body including an upper portion and a lower portion, said lower portion including a plurality of projections formed thereon;

a cap for engaging on said upper portion of said cylindrical body;

said cap having a fastener seat on top of said cap to conneet an upper fastener;

a casing including an open top for engaging with said lower portion of said cylindrical body and including an enclosed bottom, said casing including an upper portion having at least one channel formed therein for engaging with one of said projections so as to retain said casing to said cylindrical body;

said upper portion of said casing including at least two ribs laterally formed therein and spaced with each other so as to define said channel therebetween;

said channel including one side having a stop formed thereon for engaging with said projection so as to prevent said projection from disengaging said channel;

said cylindrical body including an outer peripheral surface, and said projections projected radially outward from said outer peripheral surface of said cylindrical body;

said casing having a threaded end;

a hollow cylindrical seat disposed beneath said casing, said cylindrical seat having an inner threaded rim to receive said threaded end, a notch at a bottom of said cylindrical seat, and a lower fastener on said notch; and a strap fastening said upper fastener and said lower fastener.

* * * * *